United States Patent [19]

Okada

[11] Patent Number: 4,889,339

[45] Date of Patent: Dec. 26, 1989

[54] SLOT MACHINE

[75] Inventor: Kazuo Okada, Tokyo, Japan

[73] Assignee: Kabushiki Kaisha Universal, Tochigi, Japan

[21] Appl. No.: 861,736

[22] Filed: May 7, 1986

Related U.S. Application Data

[63] Continuation of Ser. No. 670,993, Nov. 13, 1984, abandoned.

[30] Foreign Application Priority Data

Nov. 14, 1983 [JP] Japan ..... 58-174765[U]

[51] Int. Cl.[4] ..... A63B 71/06

[52] U.S. Cl. ..... 273/143 R; 273/1 GC; 273/138 A

[58] Field of Search ..... 273/138 A, 143 R, 1 E, 273/1 GC, 148 B; 340/709

[56] References Cited

U.S. PATENT DOCUMENTS

| | | | |
|---|---|---|---|
| 3,770,269 | 11/1973 | Elder | 273/138 A |
| 4,147,350 | 4/1979 | Usami | 273/1 GC |
| 4,382,166 | 5/1983 | Kim | 273/148 B |

FOREIGN PATENT DOCUMENTS

| | | | |
|---|---|---|---|
| 2068619 | 8/1981 | United Kingdom | 273/143 R |
| 2100492 | 12/1982 | United Kingdom | 273/143 R |

*Primary Examiner*—Edward M. Coven

*Attorney, Agent, or Firm*—Young & Thompson

[57] ABSTRACT

A slot machine has a single stop button which is manipulated by a player every time it is desired to stop a plurality of moving symbol columns one after another. A selection device selects a symbol column to be stopped every time the stop button is manipulated. A stop device stops the movement of the symbol column selected by the selection device. The player can stop all of the symbol columns sequentially in a predetermined order by manipulating the single stop button as many times as the number of symbol columns.

4 Claims, 2 Drawing Sheets

SLOT MACHINE

This application is a continuation of application Ser. No. 670,993, filed Nov. 13, 1984, now abandoned.

BACKGROUND OF THE INVENTION

The present invention relates to a slot machine, and more particularly it relates to a slot machine provided with stop buttons operated by a player for stopping symbols on a winning line.

After coins (including tokens) are inserted into a slot machine, a plurality of symbol columns, such as a plurality of reels having symbols disposed on the periphery thereof, are driven in rotation or otherwise moved by pulling an operating handle. A win is determined by a predetermined combination of symbols appearing on the winning line when the reels stop. Slot machines of this kind are divided into automatic stop type slot machines wherein each reel is automatically stopped, and manual stop type slot machines wherein stop buttons for stopping respective reels are provided. With the manual stop type slot machine, a player can at any desired time manipulate respective stop buttons for sequentially stopping the reels. Therefore, with this type of slot machine, a player can make full use of his or her intuition and technique in playing game, and the game is enjoyable in a way not possible with an automatic stop type slot machine.

In a conventional manual type slot machine, for example, a three-reel type slot machine, three stop buttons are provided each of which corresponds to an individual reel. To stop all of the reels, a player is required to manipulate sequentially the three stop buttons. It is common for the slot machine to be repetitively operated, and in view of this, the manipulation by a player of the three stop buttons, which are generally mounted in different positions from each other, is very cumbersome. Moreover, the provision of respective stop buttons for each reel requires mounting almost the same parts in different positions, which is not reasonable from a standpoint of manufacture, assembly, and cost.

OBJECTS OF THE INVENTION

It is a primary object of the present invention to provide a slot machine of the manual stop type which is simple to manipulate.

It is another object of the present invention to provide a slot machine of the manual stop type in which the structure is simple and the cost is reduced.

It is a still further object of the present invention to provide a slot machine of the manual stop type in which the process of stopping symbols on the winning line can be performed electrically.

SUMMARY OF THE INVENTION

The above objects of the present invention are achieved by providing a single stop button manipulated by a player in order to stop sequentially one after another a plurality of symbol columns under movement, selection means for selecting one of the symbol columns under movement in accordance with the number of manipulations of the stop button, and stopping means for stopping the symbol column selected by the selection means.

In order to provide moving symbol columns, it may be possible to use, as described previously, those having symbols on the periphery of each of a plurality of reels.

Alternatively, as in a video type slot machine, several kinds of symbols may be sequentially displayed in a predetermined order on a CRT screen.

BRIEF DESCRIPTION OF THE DRAWINGS

Other objects and advantages of the invention will become apparent during the following discussion of the accompanying drawings, wherein.

DETAILED DESCRIPTION OF THE INVENTION

Figure 1:
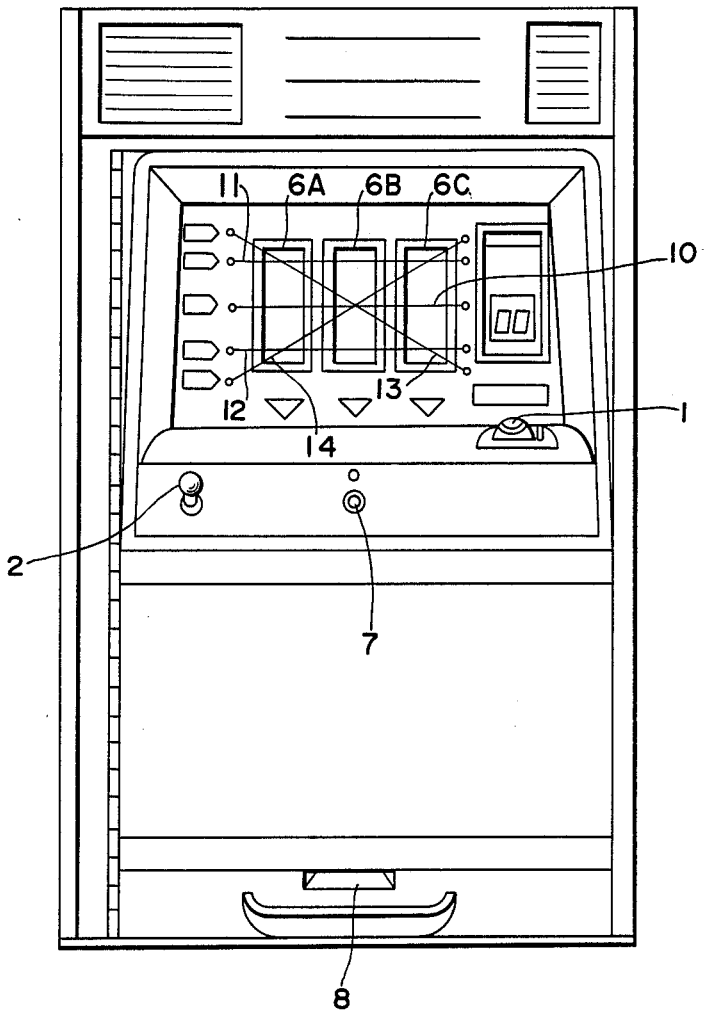
FIG. 1 shows an example of the outer appearance of a slot machine according to the present invention.

FIG. 1 shows an example of a slot machine according to the present invention. After a coin is inserted into a coin slot 1, the player manipulates a start lever 2 to drive into rotation three reels 3 to 5 having symbols disposed thereon. Through reel windows 6A to 6C, three symbols on each reel 3 to 5 can be observed when the reel stops; however, this is almost impossible while the reel is moving.

After each reel 3 to 5 reaches a constant speed of its rotation, a stop button 7 becomes operative. It is to be noted that the stop button 7 is used in common for all of the three reels 3 to 5. More particularly, a first depression by a player of the stop button 7 makes the first reel 3 stop, with the symbols being displayed through the reel window 6A. At any desired timing following the first manipulation, if a second manipulation of button 7 is carried out, then the second reel 4 stops. Similarly, a third manipulation makes the third reel 5 stop. Thus, after each reel is sequentially stopped, the displayed symbols on each reel may be observed through respective reel windows 6A to 6C.

A winning line 10 is provided for use in common with all the reel windows 6A to 6C. When all the reels 3 to 5 stop as described above, a win decision is made based on the combination of symbols stopping on the winning line 10. In addition to the winning line 10, it is possible to provide other winning lines 11 to 14 as shown in FIG. 1. In this way, it is possible to increase the number of effective winning lines in accordance with the number of coins inserted prior to the start of a game.

As a result of the win decision, if in fact there is a win, as many coins as the number corresponding to the kind of that win are paid out from a payout outlet 8.

Figure 2:
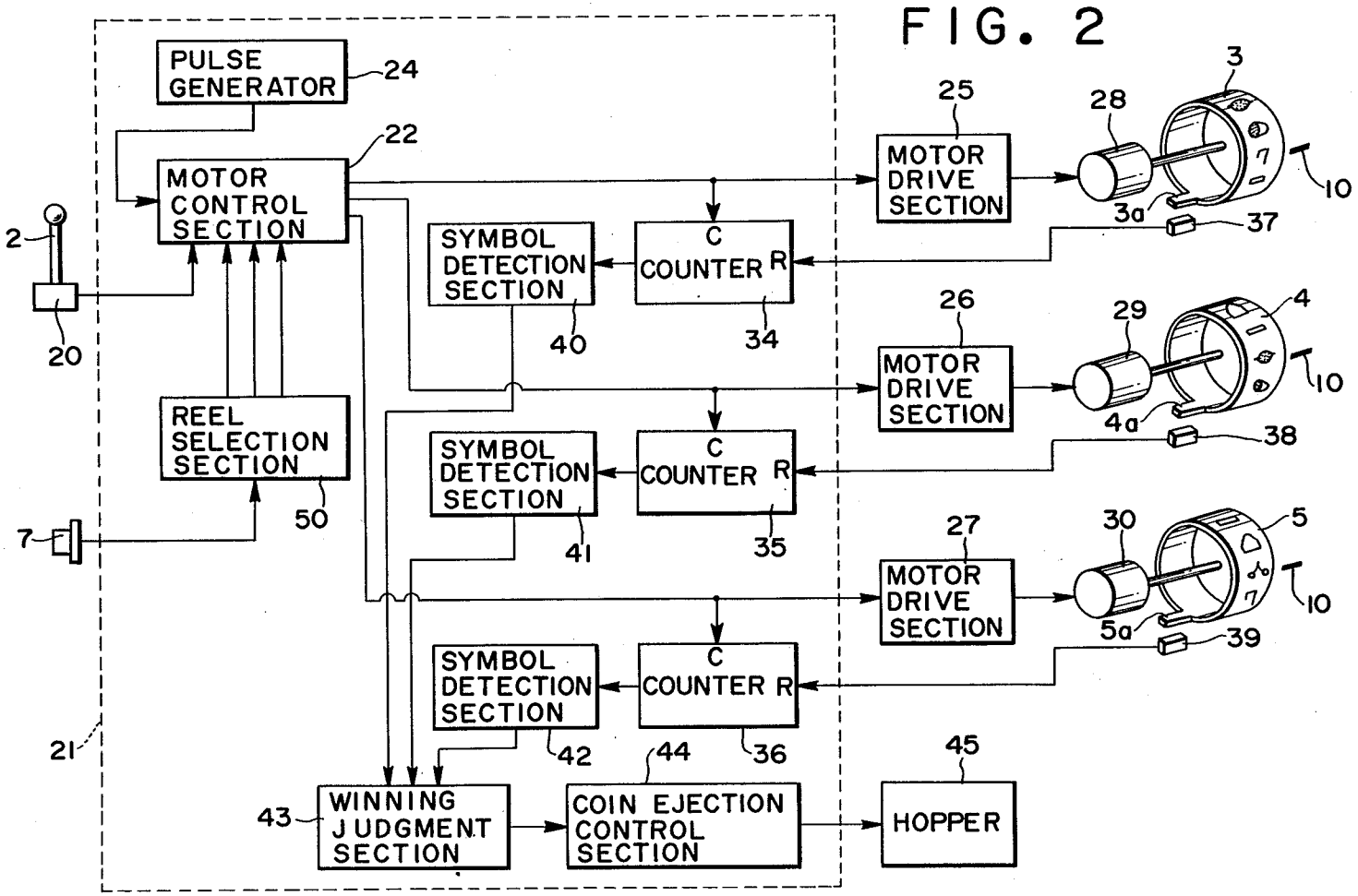
FIG. 2 is a block diagram showing the construction and arrangement of an embodiment of a slot machine according to the present invention.

The above is performed under the control of a system including a microcomputer 21 shown in FIG. 2. In FIG. 2, upon manipulation of the start lever 2 mounted on the front portion of the slot machine, a start signal generator 20 outputs a start pulse. The start pulse is input to a motor control section 22, and in turn drive pulses generated at the pulse generator 24 are supplied through the motor control section 22 to motor drive sections 25 to 27, thereby driving stepping motors 28 to 30. As a result, each reel 3 to 5 rotates and a game starts. The drive pulses for driving the respective stepping motors 28 to 30 are on the other hand cumulatively counted by respective counters 34 to 36 provided for each reel. The cumulative count value of the drive pulses is utilized in identifying the symbols on each reel as will be described later. To this end, it is necessary to reset to zero the respective reset counters 34 to 36 every one rotation of a reel. The reset pulse for this purpose is obtained by detecting light interception lugs 3*a* to 5*a* mounted on each reel 3 to 5 by means of photointerrupters 37 to 39.

When each reel 3 to 5 reaches a constant speed of rotation, it is possible to manipulate or depress the stop button 7 to stop the reel rotation Each time the stop button 7 is manipulated, a stop pulse is output to the reel selection section 50. The reel selection section 50 comprises for example a shift counter and outputs a special stop signal to the motor control section 22, the stop signal being composed of a combination of "H" and "L" signals (high level and low level signals) defined in accordance with the number of depressions of the stop button 7 and corresponding to each reel.

The motor control section 22, which includes a decoder for interpreting the stop signal, terminates the drive pulses supplied thereto from the pulse generator 24 so as to stop the stepping motor corresponding to the stop signal supplied to the motor control section 22. Therefore, for example a first depression of the stop button makes the stepping motor 28 driving the first reel stop, a second depression makes the stepping motor 29 stop, and a third depression makes the stepping motor 30 stop.

After all of the reels 3 to 5 stop, symbols for respective symbols stopping on the winning line 10 are identified by symbol detection sections 40 through 42 with reference to the counted value of the drive pulses in the pulse counters 34 to 36. The symbols for respective reels which are transformed into a code comprised by a certain number of pulses are judged by a win judgment section 43 as to whether the three symbols of the reels on the winning line 10 correspond to a winning combination or not; and if it is a win, the number of coins to be paid is determined. These decisions are performed with reference to a winning table (for example, a ROM memory is used) included in the win judgment section. If a win occurs, an appropriate number of coins are paid out by a coin ejection control section 44 into a hopper 45.

The present invention may also be applied to a slot machine of a "credit type" in which without inserting coins for each game or without paying out coins for each win, a game is continued with a display of the numbers of coins used and coins obtained for each game, by inserting a plurality of coins at the start of the game, or by using a credit card which enables a data entry of the number of coins available at the time. In such a "credit type" slot machine, at the end of a game, a settlement button is manipulated, and by calculating the number of coins used and coins obtained, an appropriate number of coins are paid out, or the credit card is updated with new data at the time.

As a modification, the reel selection section 50 may have a self-selection function which makes it possible to stop each reel in a random order or in an order desired by a player. To this end, for example, a signal indicative of the depression of the stop button 7 is used as a signal opening a gate of the reel selection section 50 such that the stop signal generated randomly from each reel is made effective in accordance with the depression timing of the stop button 7, or alternatively the stop signal for a particular reel is sequentially generated in the order a player has set.

As will be appreciated from the above description, since a single stop button is commonly used for stopping each of a plurality of reels, the cumbersome manipulation of the conventional type slot machine stop buttons has been eliminated; while at the same time, according to the present invention, the player's interest in the game is not reduced and the manipulation itself is simplified. Furthermore, the stop button and the manipulation detection circuit for the stop button and the like are not required in more than a single set thereof, thereby making the slot machine construction and assembly simpler and less expensive.

Having described the invention in relation to the embodiment shown in the accompanying drawings, it is intended that the invention not be limited by any of the details of description, unless otherwise specified, but rather be construed broadly within its spirit and scope as set out in the accompanying claims.

What is claimed is:

1. In a slot machine of the type in which a plurality of symbol columns are moved and sequentially stopped, and when stopped and a winning combination of symbols occurs on a winning line a predetermined number of coins is paid out, the improvement comprising:

a single stop button manipulable by a player for stopping one after another said plurality of symbols columns in a predetermined sequence such that a first manipulation by a player will stop one of said plurality of symbol columns, and each subsequent manipulation will stop a different one of said plurality of symbol columns until the entire said plurality of symbol columns is stopped;

selection means internal to the machine for selecting each of said plurality of moving columns to be stopped, responsive to the cumulative number of manipulations of said stop button; and stop means for stopping each of the said plurality of symbol columns selected by said selection means, said stop means operating responsive to said selection means.

2. An apparatus according to claim 2, wherein said symbol column comprises a plurality of symbols disposed on the periphery of a reel.

3. An apparatus according to claim 2, wherein said reel is driven in rotation by a stepping motor.

4. An apparatus according to claim 3, wherein said stop means terminates the delivery of driving pulses supplied to said stepping motor.

* * * * *